United States Patent [19]

Guillory

[11] 4,196,314

[45] Apr. 1, 1980

[54] SOUND DISTRIBUTING SYSTEM IMPROVEMENTS

[76] Inventor: Henry Guillory, 186 Day St., San Francisco, Calif. 94131

[21] Appl. No.: 932,092

[22] Filed: Aug. 8, 1978

[51] Int. Cl.[2] ..... H04R 5/00

[52] U.S. Cl. ..... 179/1 G; 179/1 GQ

[58] Field of Search ..... 179/1 G, 1 GQ, 1 GP, 179/1 SW, 100.4 ST, 100.1 TD

[56] References Cited

U.S. PATENT DOCUMENTS

| | | | |
|---|---|---|---|
| 3,299,208 | 1/1967 | Driemeyer | 179/1 GP |
| 3,757,046 | 9/1973 | Williams | 179/1 G |
| 3,873,779 | 3/1975 | Wedan | 179/1 GQ |
| 3,982,071 | 9/1976 | Weiss et al. | 179/1 GQ |
| 4,002,836 | 1/1977 | Gardner | 179/1 GQ |
| 4,048,442 | 9/1977 | Mannila et al. | 179/1 GQ |
| 4,105,865 | 8/1978 | Guillory | 179/1 GQ |
| 4,112,255 | 9/1978 | Draw | 179/1 GQ |

*Primary Examiner*—Douglas W. Olms

*Attorney, Agent, or Firm*—Townsend and Townsend

[57] ABSTRACT

Apparatus is disclosed for cyclically communicating an audio electrical signal to a plurality of sound-reproducing elements in sequential, serial fashion. One embodiment includes a number of make-or-break type of electrical switches, one for each sound-reproducing element, operably situated about and in engagement with the periphery of a rotating cam element. Each switch has an input terminal, to which is applied the audio electrical signal, and an output terminal that is coupled to the sound-reproducing element associated therewith. Rotation of the cam element sequentially makes and breaks each switch to alternately establish and interrupt communication of the audio electrical signal to the associated sound-reproducing element. Another embodiment includes a digital counter operably coupled to a number of transistor switches that are selectively caused to conduct. Transistor switch conduction interconnects an input terminal receiving the audio electrical signal to the sound-reproducing element associated with the transistor switch.

5 Claims, 6 Drawing Figures

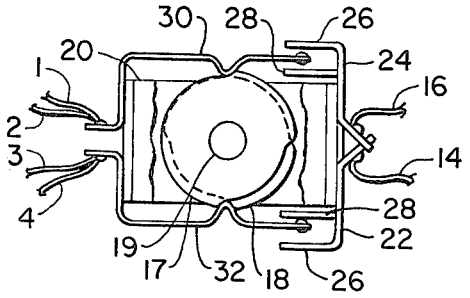
FIG._2.
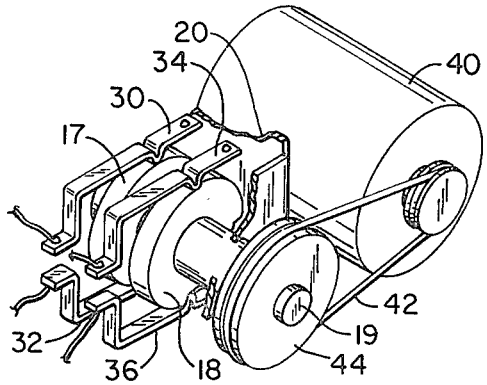
FIG._3.
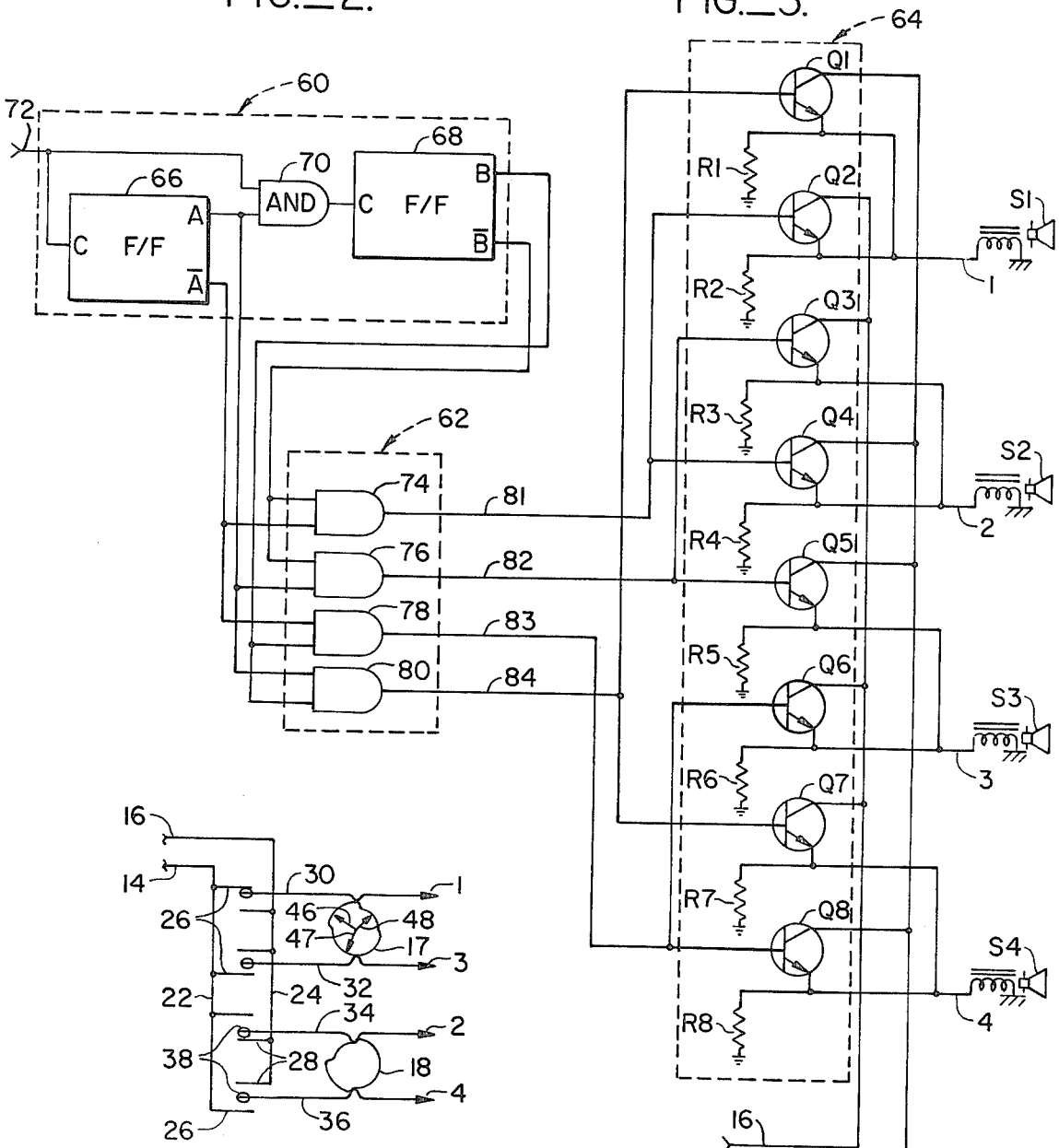
FIG._4.
FIG._5.

SOUND DISTRIBUTING SYSTEM IMPROVEMENTS

This invention relates to apparatus for sequentially distributing an audio electrical signal to a plurality of sound-reproducing elements arranged about a listening area so that the sound reproduced rotates about the listening area and simulates a spatial distribution of the sound reproduced.

BACKGROUND OF THE INVENTION

The concept of arranging a number of sound-reproducing speakers about a listening area and then selectively distributing an electrical audio signal (monaural, stereo, or quadrophonic) to the speakers is known. The concept aims at providing a listener with the sensation of movement of the sound about him or her. For example, one such distribution system employs a series of individual coils arranged to have an annular ring rotated therethrough. Each coil is serially interconnected with a corresponding speaker and amplifier. The ring is fabricated of a dielectric material, except for a short arcuate section of iron. The ring is rotated, moving the iron slug through the coil, and in so doing attenuates the speaker associated with each coil through which the iron slug passes.

Other known sound distribution devices utilize elaborate electronic amplifying techniques to achieve similar results. Representative examples of such sound distribution equipment can be found in U.S. Pat. Nos. 2,832,829, 3,873,779, and 4,002,836.

Unfortunately, systems like those described above and disclosed in the patents are not without certain problems. For example, placing a varying inductance or resistance in the signal path connecting the signal source to the speaker tends to introduce distortion into the signal and subsequently reproduced sound. Further, switching noise can also be imposed when switching the signal from one speaker to another using certain electromechanical switching techniques. Other sound distribution methods require the use of extra power or isolation amplifiers for each speaker for proper impedance matching and operation.

One method of overcoming the above-identified problems is disclosed in my U.S. Pat. No. 4,105,865, issued Aug. 8, 1978. Specifically disclosed therein is a distributor that includes a support member having mounted on an outer surface thereof a number of interconnected conductive segments, each segment corresponding to one of a plurality of speakers arranged about a listening area. A motor rotates the support member, moving each conductive segment into contact with an electrical pickup to establish electrical communication between the segment associated with the speaker and an audio signal source. While overcoming many of the problems described above, this system is subject to wear due to the continual frictional engagement between the electrical pickup and the support member. Attempts to minimize this latter problem have been limited by the lack of inexpensive, wear-resistant material that also possesses good electrical conductive properties.

SUMMARY OF THE INVENTION

Accordingly, the present invention is an improvement over my previously identified invention, which continues the advantages obtained by my prior invention, yet is substantially less subject to wear, inexpensive, simple to manufacture, and easy to use. According to the present invention, therefore, a source of at least one electrical audio signal is communicated to a plurality of sound-reproducing elements or speakers that are arranged about the perimeter of a listening area to sequentially apply the signal to each speaker in serial fashion, phasing the signal from one speaker to its adjacent speaker, so that the sound rotates about the listening area. Preferably, the signal is applied simultaneously to adjacent pairs of the plurality of speakers.

In one embodiment, the distributor includes a number of make-or-break type switches, each switch being associated with one of the speakers. The switches are mounted to a housing and situated about and in engagement with the periphery of a rotating cam element. Each switch has an input terminal, to which is applied the audio electrical signal, and an output terminal that is coupled to its associated speaker. A motor rotates the cam element in a manner that sequentially makes and breaks each switch to alternately establish and interrupt electrical communication of the audio signal to the associated speaker.

An alternate embodiment of the present invention utilizes solid-state electronics to sequentially distribute the audio electrical signal to the plurality of speakers. This embodiment includes a number of transistor switches, there being at least one switch associated with each speaker, for coupling an input terminal to a corresponding one of the speaker elements and a digital counter operably coupled to the switches. A digital pulse train is generated and applied to the counter. As the counter changes from one digital state to another, the counter outputs are decoded and applied to the transistor switches which, in turn, cause selected ones of the transistor switches to communicate the audio electrical signal to the speaker element associated therewith. Accordingly, as the counter cycles through its states, the audio electrical signal is sequentially applied to each one of the speakers, preferably in adjacent pairs, so that the sound is reproduced by the speakers in a rotating fashion.

A number of advantages are achieved by the audio signal distributor of the present invention:

First, the present invention minimizes noise or distortion sometimes introduced into the audio signal by certain of the prior art systems. The embodiments of the invention do not introduce any type of varying impedance in the signal path between the source of the signal and the speakers. Moreover, since one embodiment has no moving parts, and in other frictional engagement between moving parts is not serially between the signal source and speaker, wear is no longer a significant problem. The expense of designing and adding apparatus to attempt to obviate these undesirable features are, therefore, deleted.

Second, when the audio signal is applied to adjacent speaker pairs, in a sequential and serial fashion about the listening area, it has been found that a sensation of additional "presence" or depth to the sound is created. It is believed that the deterioration in a listener's ability to detect the sound source simulates a spatial dimension to the sound and gives the sense of improving the acoustical quality thereof through the use of multiple speakers.

Finally, the present invention is achieved through apparatus that is of simple construction, requires a minimum number of parts, is inexpensive to manufacture (and maintain) and simple to use. In particular, the present invention can easily be inserted into existing sound systems without requiring the use of additional amplifiers or impedance matching devices.

For a fuller understanding of the nature and advantages of the invention, reference should be had to the ensuing detailed description taken in conjunction with the accompanying drawings.

BRIEF DESCRIPTION OF THE DRAWINGS

FIGS. 2 and 3 are plan views, partly in section, of the cam-operated embodiment of the present invention;

FIG. 4 is a schematic representation of the cam-operated embodiment of the present invention shown in FIGS. 3 and 4;

FIG. 5 is a schematic representation of the electronic embodiment of the present invention.

DETAILED DESCRIPTION OF THE EMBODIMENTS

Figure 1:
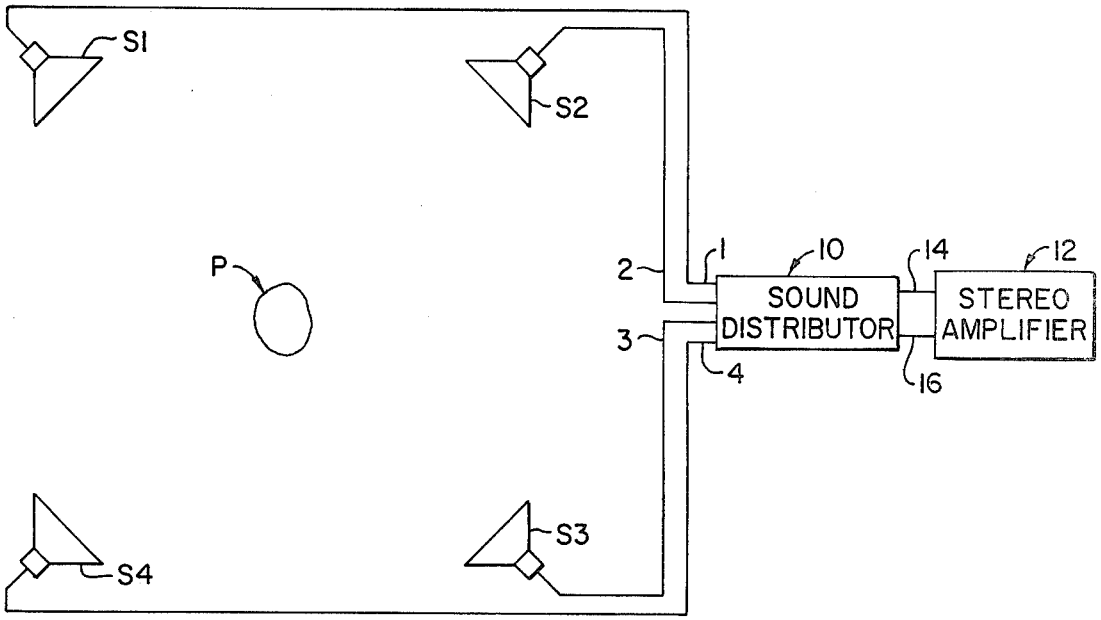
FIG. 1 is a schematic block diagram illustrating arrangement of a system utilizing the audio signal distributor of the present invention.

Turning now to the drawings, FIG. 1 illustrates the use of the audio signal distributor of the present invention. Generally designated by the reference numeral 10, the present invention distributes a pair of audio signals from a source such as a stereo amplifier 12 to four audio speakers S1–S4. Interconnecting the output section (not shown) of the left and right channels of the stereo receiver 12 and distributor 10 are audio cables 14 and 16. Although not specifically illustrated, it is common knowledge in this art that such audio cables are of the twin lead type; that is, one lead of each cable is the signal-carrying lead while the other is the amplifier ground or return. Similarly, electrical speaker wires 1–4 interconnecting distributor 10 and speakers S1–S4 are also of a twin lead variety. The common or ground lead of each speaker wire 1–4 is interconnected with the ground leads of audio cables 14 and 16 to establish a common ground between the speakers, the distributor, and the receiver 12.

It should be understood that although FIG. 1 illustrates the use of distributor 10 with a receiver 12 having two (stereo) outputs, the present invention is also ideally adaptable for use with monaural apparatus. In the case of monaural devices, however, the single output would be split into two identical audio electrical signals using an appropriate Y-connector. These two signals would then be applied to distributor 10 via audio cables 14 and 16.

Preferably, distributor 10 operates to sequentially apply the audio signals received to selected adjacent pairs of speakers S1–S4 in serial fashion; that is, the audio signal communicated to distributor 10 via audio cable 14 is applied to only one of the speakers S1–S4 at a time in sequential fashion. In similar manner, the audio signal communicated to distributor 10 via audio cable 16 is applied to the particular speaker immediately adjacent the one to which the signal communicated by audio cable 14 is applied. Thus, the two audio signals are sequentially applied to adjacent pairs. For example, assume the electrical signals communicated to distributor 10 are to be applied to speakers S1–S4 with the signal supplied by audio cable 14 leading the signal supplied by audio cable 16. Thus, speakers would be activated to reproduce the sound information contained in the electrical signals in a cyclic sequence that would progress about a listener positioned at station P beginning with adjacent pairs S1–S2, then proceed to S2–S3, to S3–S4, and so on.

So distributed, the sound reproduced by speakers S1–S4 from the audio signals communicated to distributor 10 revolves about the listener situated in the listening area defined by the arrangement of the speakers shown in FIG. 1. The listener perceives the sound as revolving about him or her. As the sound does revolve, the inability of the listener to accurately pinpoint the sound source is impaired which, in turn, simulates the addition of a spatial dimension. In effect, the sensation of, if not actual, improved acoustic quality of the sound is achieved. This sensation is obtained using either monaural or stereo sound.

Having set forth the objects sought to be achieved by the audio distributor of the present invention, and the operative manner by which these objects are attained, the construction and operation of the embodiments of the present invention will now be discussed. Referring first to FIGS. 2–2, there is illustrated one arrangement for distributing the audio signals applied to distributor 10. The distributor is shown as including a pair of disc-like cams 17 and 18 fixedly mounted parallel to one another to shaft 19. Shaft 19, in turn, is mounted for rotation to housing 20. Also mounted to the housing are conductors 22 and 24 to which are electrically connected coupled audio cables 14 and 16 from the amplifier 12 (FIG. 1). Conductors 22 and 24 are attached to the housing so that they are electrically isolated therefrom, as well as being electrically isolated from one another, to avoid electrical cross-talk therebetween. Conductors 22 and 24 are provided with laterally extending fingers 26 and 28, respectively.

Also mounted to housing 20, but electrically isolated therefrom, are switch arms 30, 32, 34 and 36 (as viewed in FIG. 2, only contact arms 30 and 32 are visible). The switch arms are mounted so that they lie in a plane defined by cams 17 and 18 and are positioned so that they engage the peripheries of the cams at a midpoint of each arm. The distal end of each switch arm is provided with a contact point 38 which is positioned between finger pairs 26 and 28 of the conductors. Electrically attached to the other ends of each switch arm 30, 32, 34 and 36 are the speaker wires 1–4, respectively, thereby electrically coupling each individual switch arm to its corresponding speaker.

Motor 40 is provided for rotating cams 17 and 18. The motor is coupled to distributor 10 by belt 42 and drive pulley 44, the latter being attached to an end of shaft 19. Motor 40 is of conventional manufacture and design. It is preferable, however, that the motor be provided with some motor speed control. This provides the user with th : ability to vary the rate of rotation of cams 17 and 18 which, in turn, varies the rotation of the sound that is reproduced and rotated by speakers S1–S4. It has been found that the most pleasing effects are obtained when sound rotation about a listener is between 1–40 revolutions per minute (RPM).

Each switch arm 30–36 is manufactured from a conductive material that is spring-like in nature, such as spring steel or the like. Each switch arm is mounted housing 20 in such a way that its inherent springiness biases the switch arm toward shaft 19 so that the switch arm continually engages cam 17 or 18.

The outer peripheries of cams 17 and 18, upon which switch arms 30–36 ride, are formed to have three separate radii of curvature 46, 47 and 48. These three radii of curvature allow the cams, as they rotate, to place the contact points of each switch arm into one of three positions: Electrical contact with a finger 26 of conductor 22, electrical contact with a finger 28 of contact bar 24, or intermediate both fingers 26 and 28 associated with the switch arm and out of contact therewith. These three positions are illustrated in FIG. 4 by switch arm 30, switch arm 32, and switch arm 34, respectively. The two radii of curvature 46 and 48 each define arcs on the peripheral portions of each cam of 90° duration. Radius of curvature 47 defines an arc of 180° duration. Thus, for example, as cam 17 rotates, switch arm 32 is sequentially moved into touching and electrical engagement with contact fingers 26 and 28 for 90° of rotation each and will be situated intermediate (and out of electrical contact) with either contact finger for 180° rotation of the cam.

In operation, shaft 19 is caused to be rotated by motor 40 at approximately 20 RPM. As shaft 19 rotates, cams 17 and 18 also rotate, causing the switch arms 30–36 to be moved into one of the three positions referred to above. For example, assuming counterclockwise rotation of cam 17 (FIG. 4), switch arm 30 (shown in a first position placing the contact end in engagement with finger 26 of contact bar 22) will alternately be moved from this first position to the second position (in electrical contact with its corresponding finger 28 of contact bar 24) via the peripheral portion formed by radius of curvature 48; from the second position, cam 17 will move the switch arm to the third position intermediate both contact fingers. The other switch arms (e.g., switch arms 32–36) are put through a similar progression by the cams associated with each switch arm. The cams 17 and 18 are situated with respect to one another (e.g., their respective peripheral edges defined by radii of curvature 46–48) so that they cause only two of the switch arms 30–36 to be engaged with fingers 26 or 28 of the contact bars at any one time. In this way the audio electrical signal applied to contact bars 22 and 24 are communicated to adjacent pairs of speakers S1–S4 via the contact established between the respective switch arms and fingers of the contact bars.

Rotation of cams 17 and 18 will cause the signal applied to audio cable 14 to be sequentially communicated to switch arms 30–36 which, in turn, couple the signal to speaker wires 1–4 and speakers S1–S4, respectively. For example, as FIG. 4 illustrates, clockwise rotation of cams 17 and 18 will cause the audio electrical signal applied to audio cable 14 to be communicated to speaker leads 1–4 in a sequential manner, the communication being established for a duration of 90° of cam rotation, as explained above. In similar manner, the audio electrical signal applied to audio cable 16 will be communicated to speaker wires 1–4, 90° of shaft 19 rotation behind the signal applied to audio cable 14. In such manner, as previously described and illustrated with respect to FIGS. 1 and 2, this particular embodiment of the present invention distributes the audio electrical signals produced by amplifier 12 to the respective speakers S1–S4 to simulate rotation of the sound reproduced by the speakers about a listening area defined by the speakers.

Figure 6:
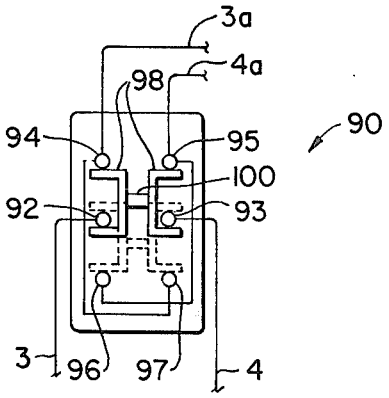
FIG. 6 is a schematic representation of a switch that may be used in connection with either embodiment of the present invention to cause the distributed signal to be reproduced by the speakers of FIG. 1 in a simulated figure-eight pattern.

Turning now to FIG. 5, there is illustrated an alternate embodiment of the present invention; an embodiment that uses solid-state electronics to perform the signal distribution described above. As FIG. 6 illustrates, the distributor system of this embodiment includes a counter 60, the outputs A, $\overline{A}$, B and $\overline{B}$ of which are coupled, via decoder 62, to switching network 64. Counter 60 includes flip-flops 66 and 68 and an AND gate 70.

The outputs A, $\overline{A}$, B and $\overline{B}$ of flip-flops 66, 68 are coupled to AND gates 74–80 of decoder 62 where each individual digital state that counter 60 assumes is decoded. The output lines 81–84 of decoder 62 are connected to switching network 64 where they are applied to the bases of selected pairs of transistor switches Q1–Q8. The collectors of transistors Q1, Q4, Q5, and Q8 are electrically connected to one another as well as to audio cable 14. Similarly, the collector terminals of transistors Q2, Q3, Q6 and Q7 are electrically connected together and to audio cable 16. Each emitter terminal of transistors Q1–Q8 are electrically connected to resistors R1–R8, respectively. In addition, each emitter terminal is electrically connected to one of the speaker wires 1–4 as well as being connected to one of the remaining transistor emitter terminals. Thus, the emitter leads of transistors Q1 and Q2 are electrically tied together and to speaker wire 1; emitter leads of transistors Q3 and Q4 are electrically connected to one another and speaker wire 2; emitter leads of transistors Q5 and Q6 are electrically connected together and to speaker wire 3, while emitter leads of transistors Q7 and Q8 are connected to one another and speaker wire 4. Additionally, each emitter is connected to common ground 85 of the circuit through one of resistors R1–R8. It is presently contemplated that each of resistors R1–R8 will have a value of approximately 180 ohms.

Flip-flops 66 and 68 are of the type that change state upon receipt of a digital pulse. A state of the flip-flop is indicated by one of the flip-flop outputs being at a higher voltage level relative to the other output. For example, if flip-flop 66 is considered to be in the "one" state, output A of flip-flop 66 will be at a "one" or higher voltage level (usually in the neighborhood of 3.6 volts D.C.) relative to output $\overline{A}$ (which will be at the "zero" voltage level of approximately 0.6 volts D.C.). Receipt of a digital pulse via counter terminal 72 will cause flip-flop 66 to change state, indicated by outputs A and $\overline{A}$ assuming "zero" and "one" voltage levels, respectively. AND gates 70 and 74–80 are of the coincidence type (assuming positive logic) whose outputs will obtain a "one" voltage level only when both inputs are also of a "one" voltage level. When there is no coincidence at the inputs of any AND gate (e.g., when one or all inputs are at a "zero" voltage level), its respective output will be at a "zero" voltage level.

Constructed as described above, the electronic embodiment of the present invention operates as follows: A digital pulse is applied to counter terminal 72 to cause counter 60 to continuously count through its four available states. As each individual state of counter 60 is assumed, positive coincidence between a pair of outputs A, $\overline{A}$, B, and $\overline{B}$, of counter 60 will occur; that is, at least two of the outputs of flip-flops 66 and 68 will be at a "one" voltage level. This coincidence will be detected by one of the AND gates 74–80 of decoder 62 which, in turn, will cause one of the decoder output lines 81–84 to assume a "one" voltage level. The transistor pair tied to the particular decoder output 81–84 that is at the "one"

voltage level, will be caused to conduct and will, in fact, be placed deeply in conduction. In turn, the particular conducting transistor will effectively communicate the audio electrical signal applied to the particular audio cable 14 or 16 to which the collector of the conducting transistor is attached to its emitter to the associated one of speakers S1–S4.

It will be evident to those skilled in the art that if any one of transistors Q1–Q8 is not conducting, the transistor exhibits an extremely high impedance when viewed from between its associated collector lead. Thus, when in a non-conducting state, transistors Q1–Q8 effectively disconnect the audio cables 14 or 16 from speaker wires 1–4.

An example may be advantageous for understanding the invention illustrated in FIG. 6. Assume counter 60 to be in the state represented by flip-flop outputs $\overline{A}$ and $\overline{B}$ being at the "one" voltage level. It will be noted that coincidence between only these two outputs be made at AND gate 74, causing output 81 to assume a "one" voltage level. Since output 81 is connected to the base leads of transistors Q2 and Q4, these transistors are placed in conduction, causing audio cables 14 and 16 to be electrically communicated to speaker wires 1 and 2, respectively. Note that since coincidence is not achieved at AND gates 76–80,the outputs 82–84 are at a "zero" voltage level and the transistors connected to these outputs (e.g., Q1, Q3, and Q5–Q8) are in a non-conducting or "off" state to effectively disconnect audio cables 14 and 16 from the speaker wires associated with these transistors.

When the next digital pulse is received by counter 60 via clock terminal 72, flip-flop 66 will change state so that output A assumes a "one" voltage level while output $\overline{A}$ will change to a "zero" voltage level. Note that flip-flop 68 remains unchanged because the digital pulse was blocked by non-coincidence at AND gate 70. This change of state of counter 60 to the next count causes coincidence at AND gate 74 to cease and establishes coincidence at AND gate 76. Thus, transistors Q2 and Q4 cease conduction, effectively disconnecting audio cables 14 and 16 from speaker wires 1 and 2. Now, however, transistors Q3 and Q5 are placed in conduction by output 82 of AND gate 76 being at a "one" voltage level. Since transistors Q3 and Q5 are now in conduction, audio cables 14 and 16 are communicated to speaker wires 3 and 2, respectively.

Thus, as each digital pulse is received by counter 60, selected pairs of transistors Q1–Q8 are caused to conduct, thereby communicating the audio electrical signals applied to audio cables 14 and 16 to selected pairs of speaker wires 1–4 and speakers S1–S4. The audio electrical signal applied to audio cable 14 is sequentially applied to speakers S1–S4 in rotating fashion about the perimeter of the listening area (FIG. 1). In similar manner, the audio electrical signal applied to audio cable 16 is also applied to a one of the speakers S1–S4 adjacent to the one to which audio cable 14 is communicated.

The sequence in which speakers S1–S4 are activated can be varied to produce unusual, but pleasing, results. For example, the above discussions have contemplated serially activating speakers S1–S4; that is, the audio electrical signal applied to audio cable 14 will be communicated first to speaker S1, then speakers S2, S3, S4, and so on, effecting rotation of the signal about the listening area. However, it has been found that a rather pleasing effect is obtained when this sequence of speaker actuation is modified to a "figure 8" configuration; that is, instead of the audio electrical signal moving from speaker S1 to S2, to S3, to S4, and so on, the signal (and, therefore, the sound reproduced) will move from speaker S1 to S2, to S4, to S3, to S1, and so on.

Illustrated in FIG. 7 is a double-throw, double-pole switch 90 wired to effect this modification. Switch 90 includes input contacts 92, 93 and output contacts 94–97. Situated for slidable movement between the contacts are a pair of shorting bars 98 mechanically connected to one another by an electrically non-conductive element 100. Shorting bars 98 are movable between a first and second position to electrically communicate input contacts 92, 93 to output contacts 94, 95 or 96, 97, respectively.

Switch 90 is wired so that output contact 95 is electrically connected to output contact 96, while output contact 94 is electrically connected to output contact 97. Switch 90 is used in conjunction with either of the embodiments of the invention described above by breaking connection between the distributor and speakers S3 and S4 and connecting speaker wire 3 to input terminal 92 of switch 90 and speaker wire 4 to input terminal 93. Leads 3*a* and 4*a* of switch 90 are then tied to speakers S3 and S4.

With shorting bars 98 in the first position, as illustrated in FIG. 7, speaker wire 3 is communicated to speaker element S3 via switch output 3*a* while speaker wire 4 is communicated to speaker S4 via switch output 4*a* and the audio electrical signals are applied to the speakers in the rotational fashion described above. However, if shorting bars 98 are moved to the second position (illustrated in phantom in FIG. 7) speaker wire 3 is communicated to speaker S4 via output terminals 96, 95 and output lead 4*a*. Similarly, speaker wire 4 is communicated to speaker S3 via switch contacts 97, 94 and output lead 3*a*. Thus, in effect, placing the shorting bars 98 of switch 90 in the second position effectively transposes speaker S3 and S4 in the sequence in which the audio electrical signal is applied to all speakers.

As will now be apparent, an audio signal distributor fabricated in accordance with the teachings of the present invention is relatively inexpensive to manufacture, simple to assemble and use, sufficiently small in size to conveniently be located in any sound system, and has been found to be highly effective in giving this sensation of improved acoustic quality to the sound reproduced.

While the above provides a full and complete disclosure of the preferred embodiments of the invention, it should be obvious that various modifications, alternate constructions and equivalents may be employed without departing from the true spirit and scope of the invention. For example, the sound may be applied to speakers S1–S4 in alternate pairs so that the sound reproduced by the speakers seems to move in linear fashion back and forth (e.g., the audio electrical signal applied to audio cable 14 is alternately communicated to speakers S1–S2 while the audio electrical signal applied to audio cable 16 is alternately communicated to speakers S3–S4). Further, use of the present invention need not be limited to merely four speakers. Any number of speakers from three on up can be used.

Therefore, the above description and illustrations should not be construed as limiting the scope of the invention, which is defined by the appended claims.

What is claimed is:

1. Apparatus for sequentially distributing a first and a second audio electrical signal to a plurality of sound-reproducing elements arranged to define a listening area, the apparatus comprising:

means for generating a digital pulse train;

counter means responsive to the digital pulse train for cyclically assuming a number of distinct digital states, there being at least one distinct digital state for each sound-reproducing element;

decode means responsive to the counter means for decoding each distinct digital state assumed by said counter means and for generating therefrom a plurality of output signals, there being one output signal corresponding to each distinct digital state assumed by said counter means;

switch means responsive to said output signals generated by said decode means for communicating the audio electrical signal to a selected, adjacent pair of the sound-reproducing elements for each distinct state assumed by the counter means, said switch means including a pair of transistors associated with each one of said sound-reproducing elements, each transistor having an emitter lead electrically connected to the emitter lead of the other transistor of the pair and to the associated sound-reproducing element, a collector lead, and a base lead coupled to said decoder means and responsive thereto to cause said transistor to conduct upon receipt of one of said output signals, the collector leads of said transistor pair being adapted to respectively receive said first and second audio electrical signals;

whereby as each one of the states is assumed by the counter means the first and second audio electrical signals are communicated to selected, adjacent pairs of the sound-reproducing elements in a serial manner to simulate sound rotation about the listening area.

2. The apparatus of claim 1, wherein the switch means includes a number of transistors, there being at least one transistor associated with and corresponding to each one of the plurality of sound-reproducing elements, the transistor having a base, an emitter and a collector, the base being coupled to the counter means, the audio electrical signal being coupled to the collector of the transistor and the emitter being electrically connected to the associated sound-reproducing element for communicating the audio electrical signal thereto when the transistor is caused to conduct.

3. The apparatus of claim 1, including decoding means interposed between and interconnecting the counter means and the switch means for decoding a predetermined one of the number of digital states corresponding to each of the sound-reproducing elements.

4. The apparatus of claim 2, including decoding means interposed between and interconnecting the counter means and the switch means for decoding a predetermined one of the number of digital states corresponding to each of the sound-reproducing elements and for causing a selected pair of the transistors associated with adjacent pairs of the sound-reproducing elements to conduct.

5. In a system for reproducing sound through a plurality of sound-reproducing elements situated about and defining a listening area, the system including means for generating at least a pair of audio electrical signals, apparatus for selectively distributing the signals to adjacent pairs of the sound-reproducing elements comprising:

means for coupling the generating means to the sound-reproducing elements, said coupling means including for each sound-reproducing element first and second contact elements oriented in spaced, opposing relation to one another and electrically connected to said generating means for respectively receiving a corresponding one of said pair of electrical signals, an elongate, bendable, electrically conductive arm member having one end situated between said first and second contact elements and movable between a first position that places said one end in electrical contact with said first contact element, a second position intermediate and out of electrical contact with said first and second contact elements, and a third position in electrical contact with said second contact element, said arm member being electrically coupled to the corresponding sound-reproducing element;

a set of individual cam elements, there being at least two of said arm elements associated with each of said cam elements, each of said cam elements having a peripheral surface shaped, configured, and operable engaged by said two arm elements associated therewith to cyclically move said arm elements between said first, second and third positions; and means for rotating the cam elements including a variable speed motor, including an elongate rotatable shaft to which are mounted said cam elements.

* * * * *